US005178688A

United States Patent [19]

Yu et al.

[11] Patent Number: 5,178,688

[45] Date of Patent: Jan. 12, 1993

[54] CARBURIZED BORON STEELS FOR GEARS

[75] Inventors: In-seok Yu; Yong-gueon Ji, Changweon; Gang-hyeong Kim, Jinhae, all of Rep. of Korea

[73] Assignee: Samsung Heavy Industries Co., Ltd., Kyungsangnam, Rep. of Korea

[21] Appl. No.: 810,512

[22] Filed: Dec. 19, 1991

[30] Foreign Application Priority Data

Nov. 30, 1991 [KR] Rep. of Korea ..... 91-21879

[51] Int. Cl.[5] ..... C22C 38/14

[52] U.S. Cl. ..... 148/319

[58] Field of Search ..... 420/104, 121, 126; 148/319

[56] References Cited

FOREIGN PATENT DOCUMENTS 56-69352 6/1981 Japan ..... 420/104

*Primary Examiner*—Deborah Yee

*Attorney, Agent, or Firm*—Price, Heneveld, Cooper, DeWitt & Litton

[57] ABSTRACT

A boron steel consisting of 0.18% to 0.35% C, 0.06% to 0.15%, Si, 0.50% to 1.00% Mn, 0.40% to 0.90% Cr, 0.01% to 0.05%, Al, 0.01% to 0.04% Ti, no more than 0.012% N, no more than 0.003% O, 0.0005% to 0.0030% B, and the balance Fe and impurities contained inevitably in manufacturing the steel, all percentages being based on the weight of the steel. The ratio of Ti to N is 3.4 to 6.0. The boron steel has an improvement in the reduction of heat-treatment distortion, surface oxidation in carburization and material cost, and also has superior hardenability, mechanical strength and fatigue strength.

2 Claims, 6 Drawing Sheets

CARBURIZED BORON STEELS FOR GEARS

BACKGROUND OF THE INVENTION

1. Field of the Invention

The present invention relates to boron steels for carburized gears, and more particularly to boron steels for carburized gears having an improvement in the heat-treatment distortion, surface oxidation in carburization and material cost, and having superior hardenability, mechanical strength and fatigue strength, over low alloy steels and other boron steels which are conventionally used for carburized gears.

2. Description of the Prior Art

As low alloy steels for carburized gears, there have been conventionally proposed uses of Cr-Mo steels and Ni-Cr-Mo steels containing carbon in an amount of about 0.20 weight %, taking into consideration of heat-treatment distortion, surface hardness, internal hardness and fatigue strength. However, Cr, Ni and Mo elements are rare elements which have a small estimated amount of deposits in the earth and thereby are expensive. Accordingly, the use of such expensive elements leads to the increase in the material cost of alloy steels for carburized gears.

For solving the above-mentioned problems, an attempt to use boron steels which were conventionally used for low grade parts of mechanical constructions has been made, by the applicant, in carburized gears. For example, the Korean Patent Application No. 90-19454 filed on Nov. 29, 1990 in the name of the applicant disclosed boron steels having an improvement in carburized gears. The boron steels disclosed in the Patent Application are steels for carburized gears which reduce the material cost by substituting boron for expensive nickel, chromium and molybdenum, have superior mechanical properties such as distortion in carburization, hardenability, strength and fatigue limit. However, they still have the problem of the surface oxidation in carburization which was encountered in conventional steels.

On the other hand, the surface oxidation phenomenon is caused by the fact that $CO_2$ and $H_2O$ in carburizing gas oxidized silicon, manganese and chromium in steel. Due to the oxidation of these alloying elements, the steel exhibits the reduced hardenability at its most surface layer. As a result, upon being subjected to a hardening, the steel forms a bainite structure distributed in the surface thickness about 20 μm. This bainite structure results in poor hardness and tension stress at the surface of steel. The formation and the effect of surface oxidation is well known in this technical field. In order to eliminate the disadvantage caused by the bainite structure, the removal of the grain boundary oxidation is carried out by grinding the surface of gear. Alternatively, the gear may be subjected to a running-in process using a lubricating oil promoting the surface wear of the gear. However, since these methods are achieved with respect to the contact surface of gear, the grain boundary oxidized layer remaining at the tooth root portions of gear can not be removed. In particular, the surface oxidized layer remaining at the tooth roots of gear has been recently identified as the cause of gear tooth root breakage. Therefore, it has been strongly desired to provide a basic solution of reducing the formation of surface oxidized layer.

SUMMARY OF THE INVENTION

Therefore, it is an object of the invention to provide a novel boron steel for carburized gears capable of overcoming the above-mentioned problems encountered in the prior art.

The present invention is intended to reduce the contents of easily oxidizing elements such as silicon, manganese and chromium and use boron in place of nickel, chromium and molybdenum, for the purpose of reducing the formation of surface oxidized layer which has been undesirably encountered in the prior art, as well as utilizing the effect of boron in maximum.

In accordance with the present invention, the object can be accomplished by providing a boron steel consisting of 0.18% to 0.35% C, 0.06% to 0.15% Si, 0.50% to 1.00% Mn, 0.40% to 0.90% Cr, 0.01% to 0.05% Al, 0.01% to 0.04% Ti, no more than 0.012% N, no more than 0.003% O, 0.0005% to 0.0030% B, and the balance Fe and impurities contained inevitably in manufacturing the steel, the ratio of Ti to N being 3.4 to 6.0, and all percentages being based on the weight of the steel.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
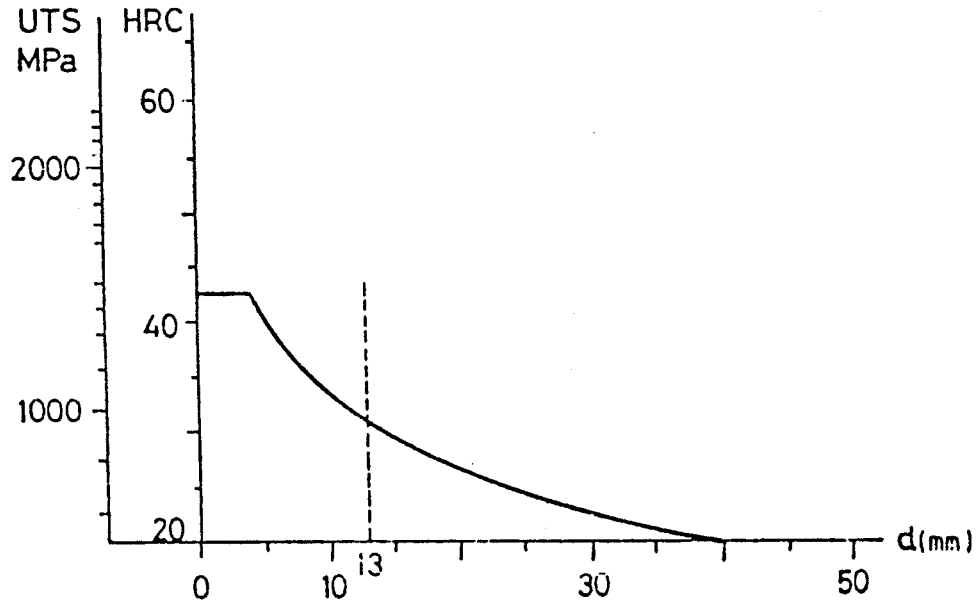
FIG. 1 is a Jominy end-quench curve for a conventional BS 708M20 steel.
Figure 2:
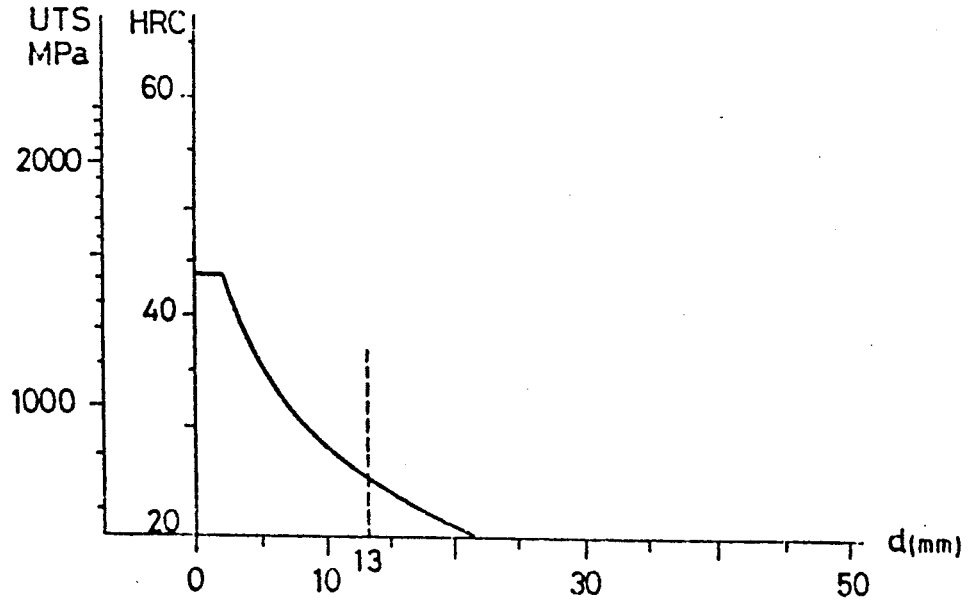
FIG. 2 is a Jominy end-quench curve for a conventional AISI 4320 steel.
Figure 3:
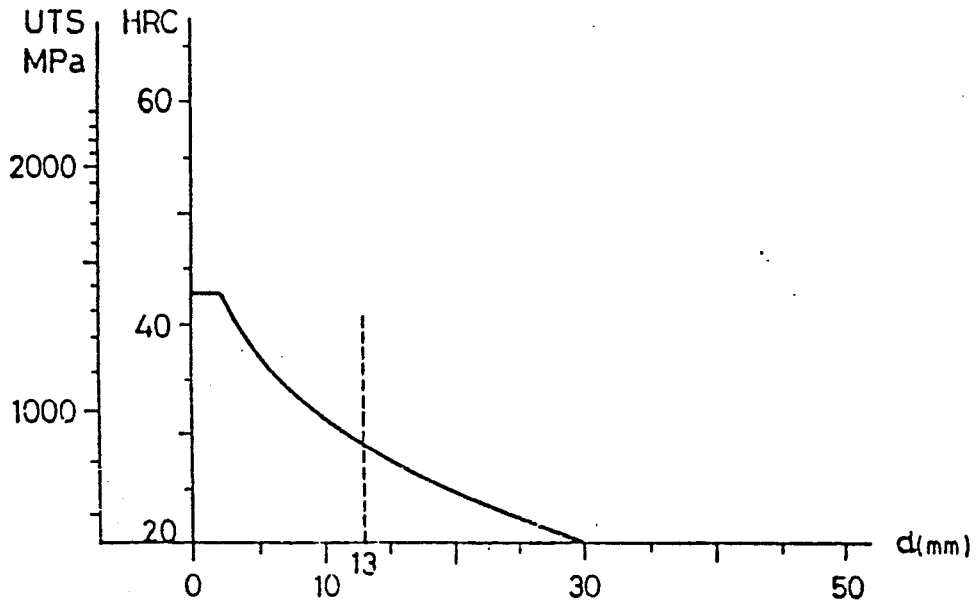
FIG. 3 is a Jominy end-quench curve for a steel disclosed in the Korean Patent Application No. 90-19454.
Figure 4:
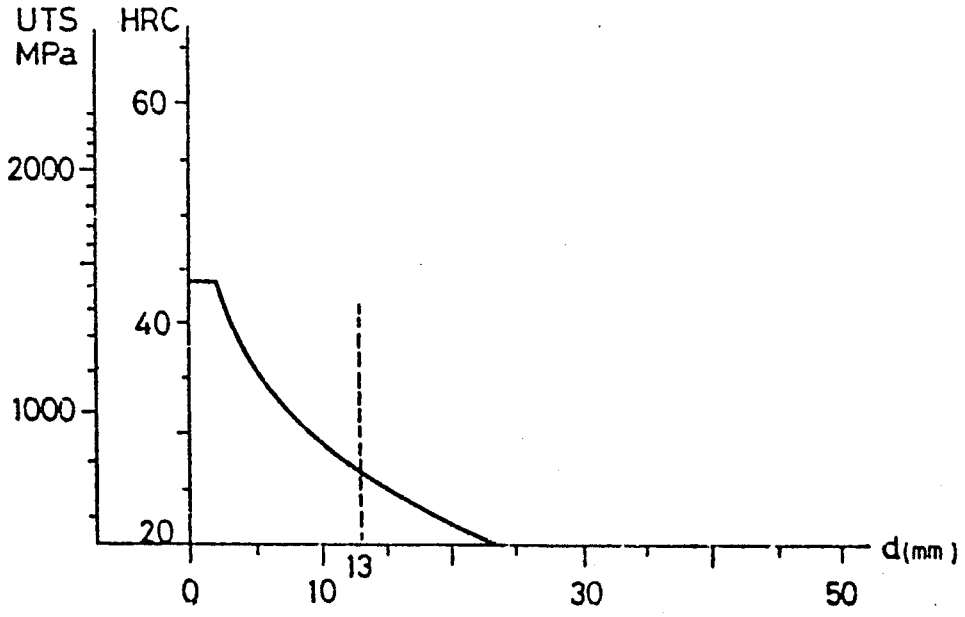
FIG. 4 is a Jominy end-quench curve for a steel in accordance with an example A of the present invention.
Figure 5:
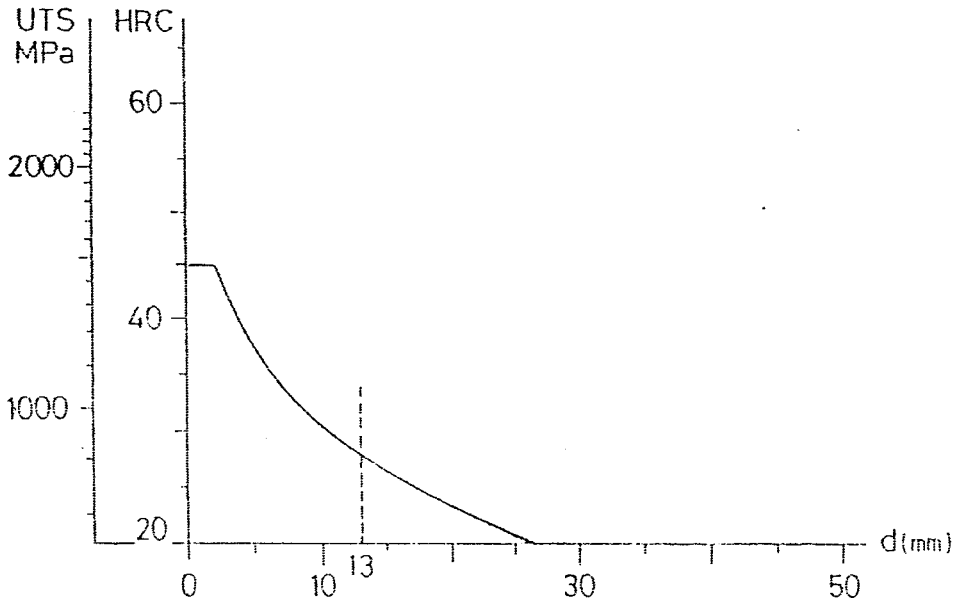
FIG. 5 is a Jominy end-quench curve for a steel in accordance with an example B of the present invention.
Figure 6:
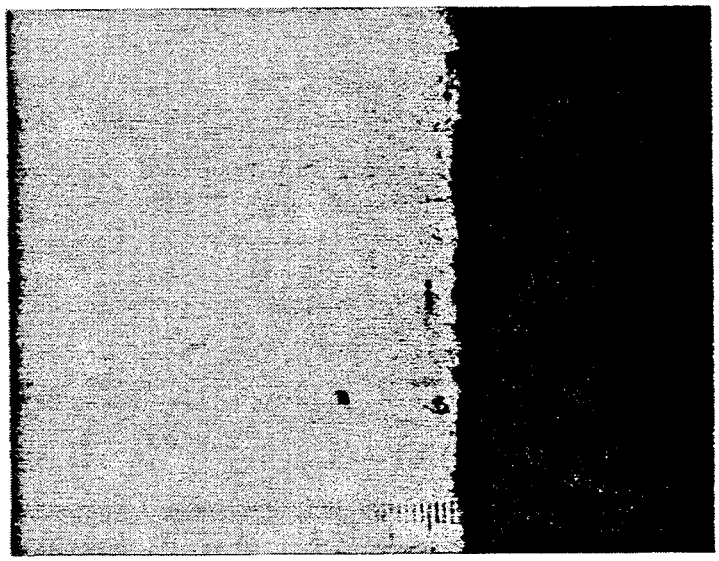
FIG. 6 is an optical microscopic photograph (×400) of the conventional BS 708M20 steel, showing the surface oxidation extent thereof.
Figure 7:
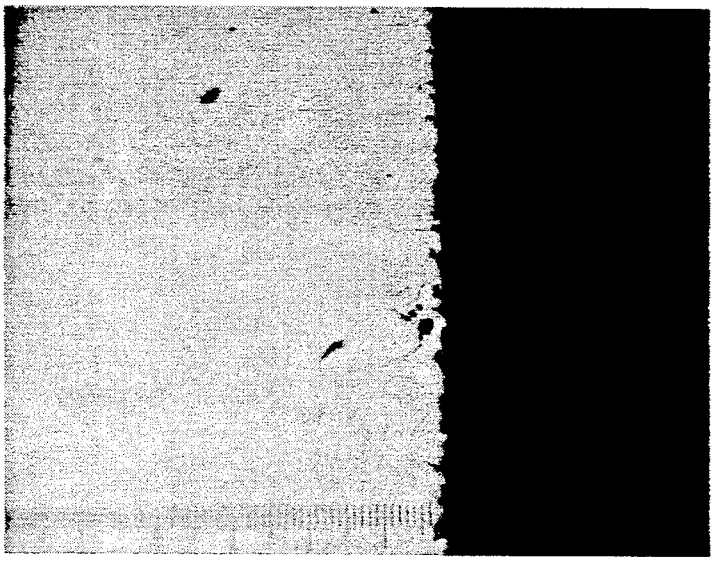
FIG. 7 is an optical microscopic photograph (×400) of the conventional AISI 4320 steel, showing the surface oxidation extent thereof.
Figure 8:
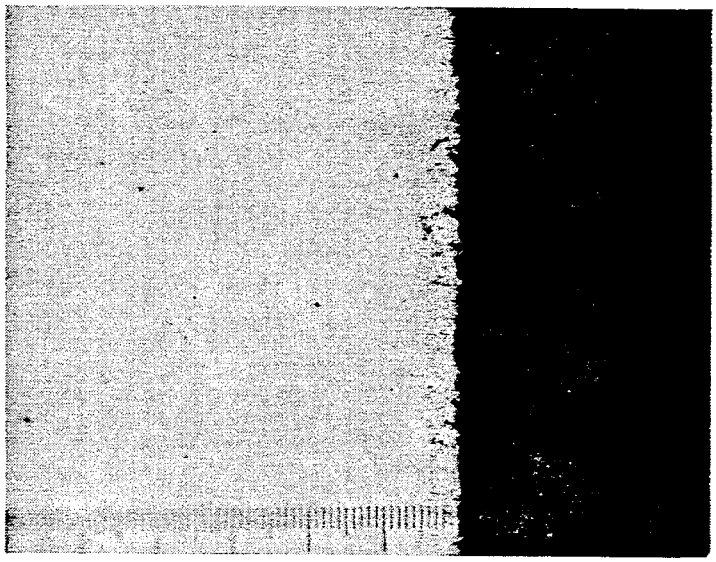
FIG. 8 is an optical microscopic photograph (×400) of the steel disclosed in the Korean Patent Application No. 90-19454, showing the surface oxidation extent thereof.
Figure 9:
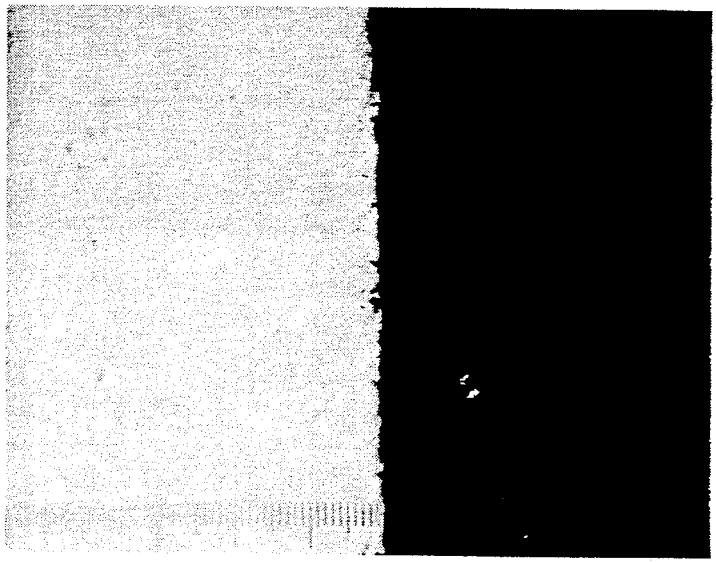
FIG. 9 is an optical microscopic photograph (×400) of the steel in accordance with the example A of the present invention, showing the surface oxidation extent thereof.
Figure 10:
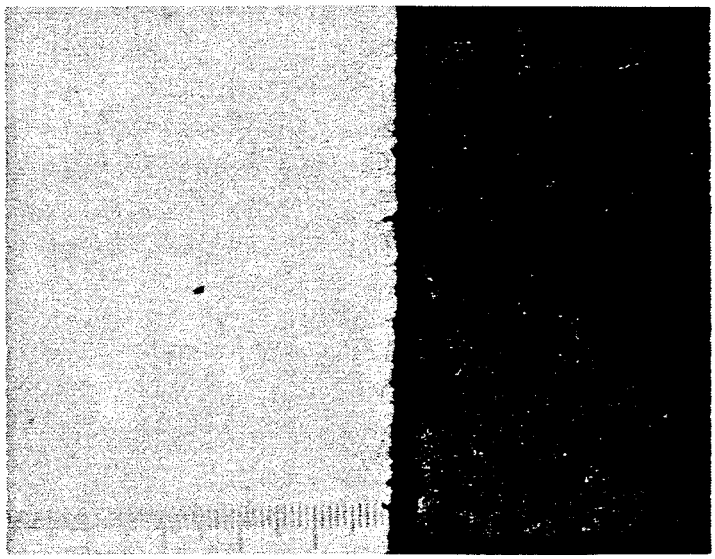
FIG. 10 is an optical microscopic photograph (×400) of the steel in accordance with the example B of the present invention, showing the surface oxidation extent thereof.

As mentioned above, the present invention reduces the contents of easily oxidizing elements such as silicon, manganese and chromium; and further, alternates boron completely or partially for nickel, chromium and molybdenum, for the purpose of reducing the formation of surface oxidized layer which has been undesirably encountered in the prior art, as well as utilizing the effect of boron in maximum.

Contents of the steel according to the present invention are numerically limited as follows.

Carbon is an essential element for obtaining strength and hardness required in steels. To maintain internal hardness of at least 20 $H_{RC}$, the composition contains carbon in an amount of at least 0.18 weight %. Carbon in excess of 0.35 weight % increases abruptly the hardness and thus adversely effects on toughness, thereby preventing the steel from being used for gears.

Silicon functions as a deoxidizer in steel manufacturing process and thus should be contained in the composition in an amount of at least 0.06 weight %. Since silicon is rapidly oxidized, accordingly, the content of silicon is limited to a maximum of 0.15 weight %, so as to reduce the surface oxidation.

Manganese is a cheap alloying element contributing to improving strength and hardenability and also an essential element adapted as desulphurizer in the steel manufacturing process. However, manganese is also one of oxidizing elements, although its oxidization level is lower than that of silicon. Accordingly, the content of manganese is limited to a maximum of 1.0 weight %. To improve hardenability, manganese should be contained in the composition in an amount of at least 0.5 weight %.

Chromium is presented as a solid solution in ferrite to strengthen its matrix. In case of the composition containing a small amount of carbon, the addition of chromium improves the matrix strengthening effect. To this end, chromium should be contained in the composition in an amount of at least 0.4 weight %. The content of chromium is also limited to a maximum of 1.0 weight %, since the element also encounters the surface oxidation as in silicon and manganese.

Aluminum is mainly used in manufacturing killed steels because it has strong deoxidization effect. Also, aluminum remaining in the steel contributes to improving toughness and refining crystal grain size. When the composition contains aluminum in an amount of less than 0.01 weight %, insufficient deoxidization is obtained. In exceeding 0.05 weight %, aluminum is contained in $SiO_2$ in a small amount so that it is resulting in poor cleanliness; the silicates are remained longer A type inclusions. Accordingly, the content of aluminum is limited to a minimum of 0.01 weight % and a maximum of 0.05 weight %, and preferably 0.20 weight % to 0.03 weight %.

Titanium has a strong bonding force with nitrogen and is thus an essential element for obtaining the desired effect expected by the addition of boron in accordance with the present invention. When titanium is contained in the composition in an amount of at least 0.01 weight %, a stable boron effect can be obtained. In exceeding 0.04 weight %, the effect is increased no longer. Accordingly, the content of titanium is limited to a minimum of 0.01 weight % and a maximum of 0.04 weight %, and preferably 0.02 weight % to 0.03 weight %.

Nitrogen is contained in the composition as nitrogen in air is dissolved therein in manufacturing steels. In exceeding 0.012 weight %, nitrogen bonds with boron to form BN which prevents the accomplishment of a desired effect according to the present invention. Accordingly, the content of nitrogen is limited to a maximum of 0.012 weight %, and preferably less than 0.009 weight %.

Oxygen is the fundamental cause of the surface oxidation to be solved by the present invention. In similar to nitrogen, oxygen is contained in the composition as oxygen in air is dissolved therein in manufacturing steels. The dissolved oxygen is mainly removed from the composition by a deoxidization process. The content of oxygen is limited to a maximum of 0.003 weight %. In exceeding 0.003 weight %, it is difficult to expect the reduction of the surface oxidation. The content of oxygen is preferably less than 0.0025 weight %.

Boron is a cheap element which functions to provide the effects of improving hardenability of steels, in place of expensive alloying elements. The addition of boron even in a very small amount will result in obtaining advantageous effects. At least 0.0005 weight % of boron should be added to the composition. In exceeding 0,003 weight %, boron may be effective no longer and rather functions to reduce toughness. Accordingly, the content of boron is limited to a minimum of 0.0005 weight % and a maximum of 0.003 weight %, and preferably 0.0015 weight % to 0.0025 weight %.

In accordance with the present invention, the ratio of titanium to nitrogen is also limited to a minimum of 3.4 and a maximum of 6. The formation of BN caused by free N can be avoided when the ratio is at least 3.4. In exceeding 6, however, the effect is increased no longer.

The present invention will be understood more readily with reference to the following examples of boron steels and the comparative examples of conventional steels; however these examples are intended to illustrate the invention and are not to be construed to limit the scope of the present invention.

In examples of the present invention, a conventional method well-known in the technical field to which the present invention pertains was used for making steels. Respective compositions of boron steels A and B of the present invention and conventional steels are described in Table 1.

TABLE 1

| Example | Composition (weight %) | | | | | | | | | | |
|---|---|---|---|---|---|---|---|---|---|---|---|
| | C | Si | Mn | Ni | Cr | Mo | B | Ti | Al | N | O |
| BS 708M20 | 0.19 | 0.27 | 0.82 | 0.12 | 1.10 | 0.19 | * | * | * | * | * |
| AISI 4320 | 0.21 | 0.23 | 0.61 | 1.61 | 0.44 | 0.19 | * | * | * | * | * |
| Patent Application No. 90-19454 | 0.20 | 0.21 | 1.05 | — | 0.31 | — | 0.0022 | 0.059 | 0.026 | 0.0076 | 0.0027 |
| Present Invention A | 0.21 | 0.13 | 0.74 | — | 0.51 | — | 0.0019 | 0.03 | 0.020 | 0.0085 | 0.0025 |
| Present Invention B | 0.23 | 0.09 | 0.51 | — | 0.75 | — | 0.0021 | 0.03 | 0.023 | 0.0071 | 0.0023 |

*without checking

Respective Jominy end-quench curves for above-mentioned steels are illustrated in FIGS. 1 to 5. By the comparison of Jominy end-quench curves, with respect to the hardness at the Jominy distance of 13 mm (½ inch) from the quenched end, it could be understood that steels A and B of the present invention had a hardness and a strength equivalent to those of conventional steels.

FIGS. 6 to 10 are respective optical microscopic photographs showing surface oxidation extents of steels mentioned above. The depth of the surface oxidized layer was 17.5 μm in case of FIG. 6, 20 μm in case of FIG. 7, 15 μm in case of FIG. 8, 8.7 μm in case of FIG. 9, and 7.5 μm in case of FIG. 10. From these results, it could be found that the depth of the surface oxidized layer in steels A and B of the present invention was approximately no more than 50 weight % of that in conventional steels.

Each sample used in the above test was prepared after being subjected to a heat treatment comprising carburizing it at 925° C. for 4 hours, hardening at 850° C. in 60° C. oil, and then tempering it 180° C. for 2 hours.

Figure 11:
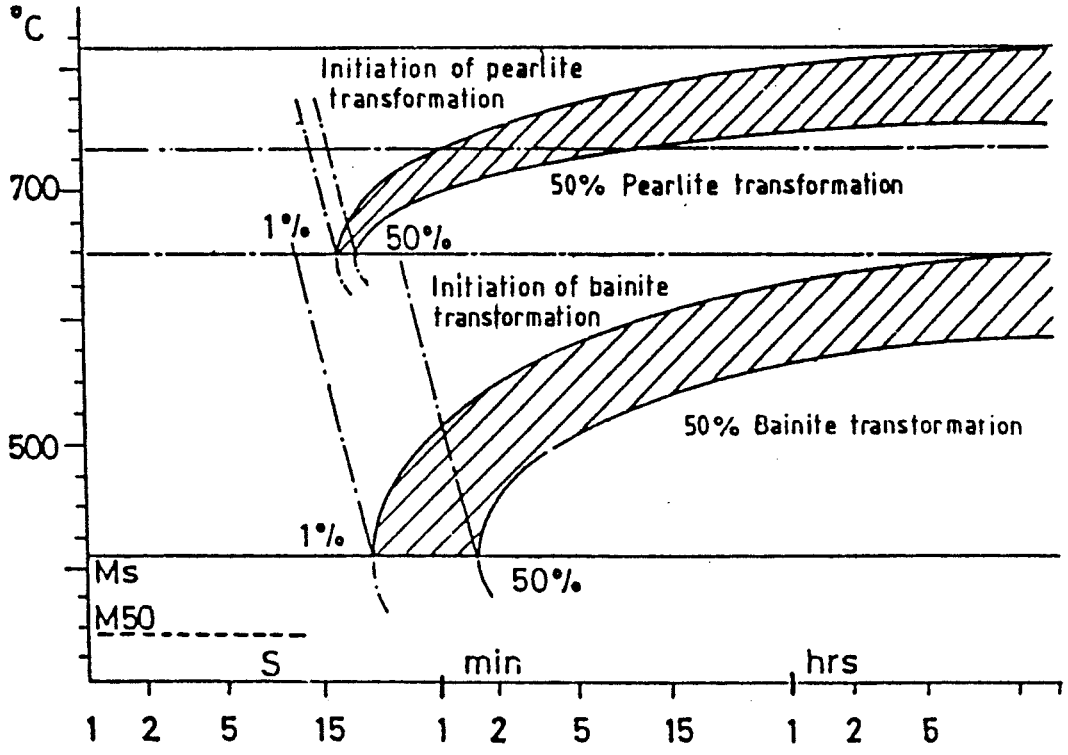
FIG. 11 is a continued cooling transformation diagram (CCT diagram) of the steel according to the example B of the present invention.

Referring to FIG. 11, there is shown a continuous cooling transformation diagram (CCT diagram) of the steel B according to the present invention. By utilizing such diagram in heat treatment, it is possible to obtain steels having desired properties in accordance with the present invention.

As apparent from the above description, boron steels for carburized gears in accordance with the present invention contains a small amount of boron which is substituted for expensive alloying elements, thereby reducing the material cost, over conventional Cr-Mo steels and Ni-Cr-Mo steels. The boron steels of the present invention also have an improvement in the reduction of thermal strain, surface oxidation in carburization, hardenability, mechanical strength and fatigue strength, over low alloy steels and boron steels which are conventionally used for carburized gears.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A carburized steel consisting of 0.18% to 0.35% C, 0.06% to 0.10% Si, 0.50% to 1.00% Mn, 0.40% to 0.90% Cr, said Si, Mn and Cr reducing surface oxidation on said steel to a layer less than 10 μm thickness, 0.01% to 0.05% Al, 0.01% to 0.04% Ti, no more than 0.12% N, no more than 0.003% O, 0.0005% to 0.0030% B, and the balance Fe and impurities contained inevitably in manufacturing the steel, the ratio of Ti to N being 3.4 to 6.0, and all percentages being based on the weight of the steel.

2. The carburized steel of claim 1, wherein it contains 0.02% to 0.03% Al, 0.02% to 0.03% Ti, less than 0.010% N, less than 0.0025% O, 0.0015% to 0.0025% B, and the balance Fe and impurities contained inevitably in manufacturing the steel, the ratio of Ti to N being 3.4 to 6.0, and all percentages being based on the weight of the steel.

* * * * *